US008955687B1

(12) United States Patent
Dews et al.

(10) Patent No.: US 8,955,687 B1
(45) Date of Patent: Feb. 17, 2015

(54) SEPARATION APPARATUS AND METHOD FOR EXTRACTING PLANT MATERIAL

(76) Inventors: Stratford Dews, Calabasas, CA (US); Kermit McCoy, Santa Monica, CA (US)

( * ) Notice: Subject to any disclaimer, the term of this patent is extended or adjusted under 35 U.S.C. 154(b) by 3 days.

(21) Appl. No.: 13/385,302

(22) Filed: Feb. 13, 2012

(51) Int. Cl.
*B07B 1/49* (2006.01)

(52) U.S. Cl.
USPC ..... 209/235; 209/417; 209/680; 222/196.1; 241/168

(58) Field of Classification Search
USPC ..... 209/235, 417, 44.3, 680, 236, 406, 311, 209/315; 222/196.1, 189.02, 189.03; 241/168
See application file for complete search history.

(56) References Cited

U.S. PATENT DOCUMENTS

| | | | | |
|---|---|---|---|---|
| 64,283 | A | 4/1867 | Coates | |
| 340,564 | A * | 4/1886 | Elliott | 222/465.1 |
| 1,347,489 | A * | 7/1920 | Bateman | 209/248 |
| 2,078,400 | A | 4/1937 | Maupin | |
| 2,294,393 | A * | 9/1942 | Erne | 222/183 |
| 2,900,760 | A * | 8/1959 | Tupper | 47/41.11 |
| 3,415,376 | A * | 12/1968 | Smith et al. | 209/236 |
| 3,512,681 | A * | 5/1970 | Frankel | 222/158 |
| 3,907,172 | A * | 9/1975 | Curtis | 222/189.07 |
| 4,121,779 | A * | 10/1978 | Mills et al. | 241/79.2 |
| 4,281,171 | A | 7/1981 | Sims | |
| 4,307,808 | A * | 12/1981 | Johnson | 209/614 |
| 4,514,993 | A | 5/1985 | Johnson | |
| 5,423,430 | A | 6/1995 | Zaffiro | |
| 5,746,355 | A * | 5/1998 | Wold | 222/189.02 |
| 6,151,910 | A | 11/2000 | Hazen | |
| 6,176,613 | B1 | 1/2001 | Chen | |
| 6,978,891 | B2 | 12/2005 | Rutledge | |
| 8,037,711 | B1 | 10/2011 | Mesaros | |
| 2006/0201974 | A1 * | 9/2006 | Schuster | 222/183 |
| 2006/0231575 | A1 * | 10/2006 | Sroufe | 222/174 |
| 2007/0074795 | A1 | 4/2007 | Moore | |
| 2007/0262089 | A1 * | 11/2007 | LeGreve | 222/189.02 |
| 2009/0202692 | A1 * | 8/2009 | Chun | 426/442 |
| 2010/0024441 | A1 | 2/2010 | Yeng | |

FOREIGN PATENT DOCUMENTS

| | | |
|---|---|---|
| JP | 3030830 | 2/1991 |
| WO | WO 2009/000274 | 12/2008 |

* cited by examiner

*Primary Examiner* — Luis A Gonzalez
(74) *Attorney, Agent, or Firm* — Dennis W. Beech

(57) ABSTRACT

The present invention may be used for separation of plant extract material from plant material. A tubular container with an open first end and a closed second end may be constructed of a rigid material. A plant material may be place in the tubular container. The tubular container may be inserted in a tubular screening container having an open first end and a screen covered second end to position the screen covered second end over the open first end of the tubular container. The separation apparatus may then be shaken with the screen covered second end over a surface for receipt of extract material. A frozen material, for example, dry ice, may be placed in the tubular container with the plant material as part of the process method.

8 Claims, 4 Drawing Sheets

22

SEPARATION APPARATUS AND METHOD FOR EXTRACTING PLANT MATERIAL

BACKGROUND OF THE INVENTION

This invention relates to apparatus and methods for separation of trichomes and extract from leaves, stems and other plant material. The plant material to be processed may be *stevia*, hemp, jute, sage, hops, peppermint, lemon balm and the like. The new apparatus and method has a tubular container with a closed end removably inserted in a second container, pouch or bag with a screen or mesh end all sized to be shaken in a person's hands.

A freezing material such as ice, cold water, dry ice and the like may be known for use in conditioning a material or substance for treatment. This use may be for purposes of hardening the material such as plant material, polymers and other non-rigid material for purposes of cleaning, separation of outer layers of material, filamentous outgrowth, epidermal hair structures and the like. Often the methods and apparatus used for treatment of the frozen or hardened material is a structure to maintain the material in a rigid state while the material is agitated in some manner to separate the outer layer of material from the underlying structure. The apparatus may be vibrated or shaken by a machine or moved by hand in a rocking motion. The apparatus may also include depositing the material in a first container having a screened bottom and then nesting in a second container having a smaller mesh screen bottom for the combination to be inserted in an ice and water mixture to be agitated by a stringing or mixing device to separate the various sizes of material.

SUMMARY OF THE INVENTION

The present invention is directed to apparatus and methods for separation of plant extract material from plant material. A tubular container with an open first end and a closed second end may be constructed of a rigid material. A plant material may be place in the tubular container. The tubular container may be inserted in a tubular screening container having an open first end and a screen covered second end to position the screen covered second end over the open first end of the tubular container. The separation apparatus may then be shaken with the screen covered second end over a surface for receipt of extract material. A frozen material, for example, dry ice, may be placed in the tubular container with the plant material as part of the process method.

These and other features, aspects and advantages of the present invention will become better understood with reference to the following drawings, description and claims.

DETAILED DESCRIPTION

Figure 1:
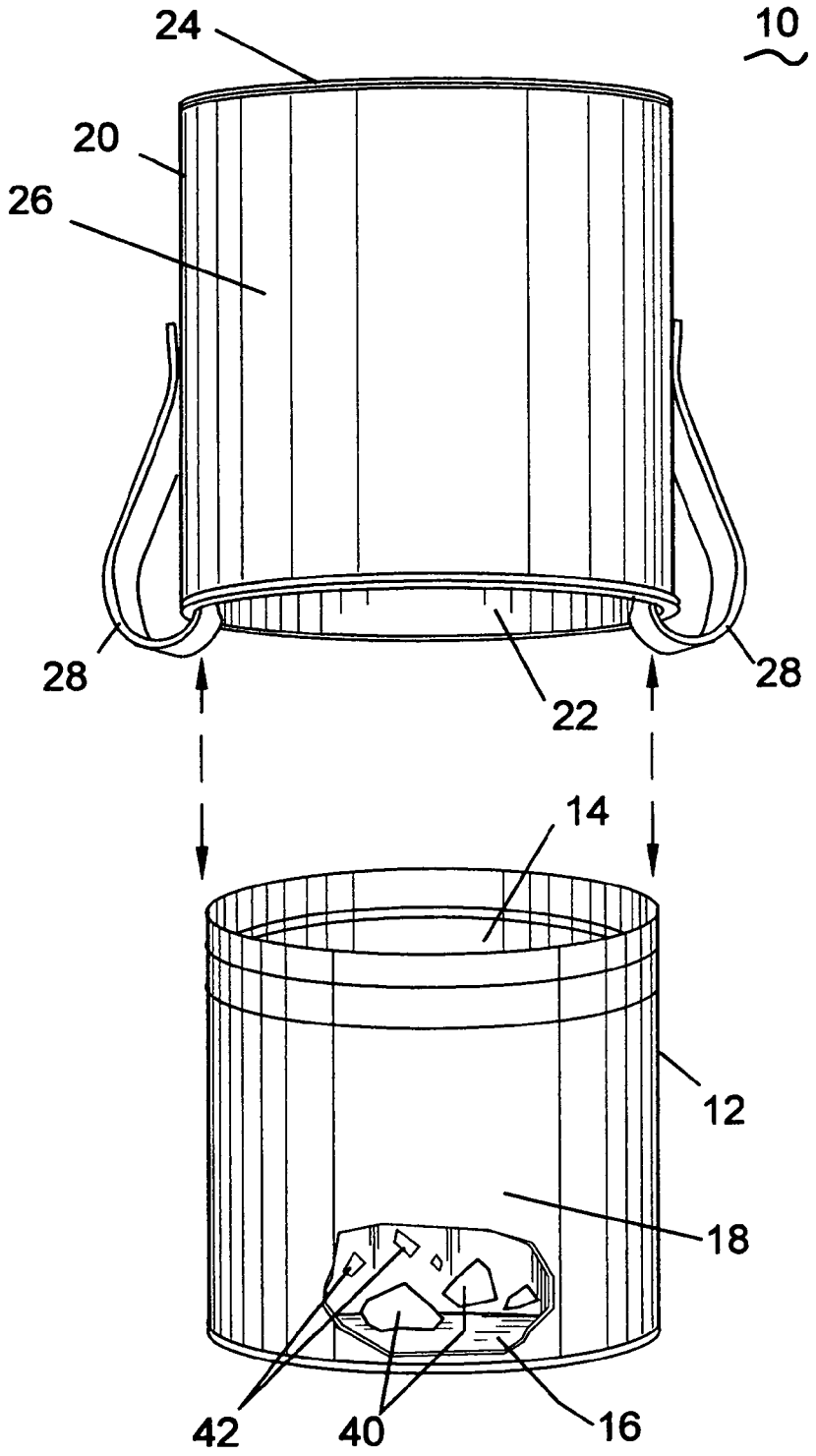
FIG. 1 illustrates a an exploded view of a separation apparatus according to an embodiment of the invention.
Figure 3:
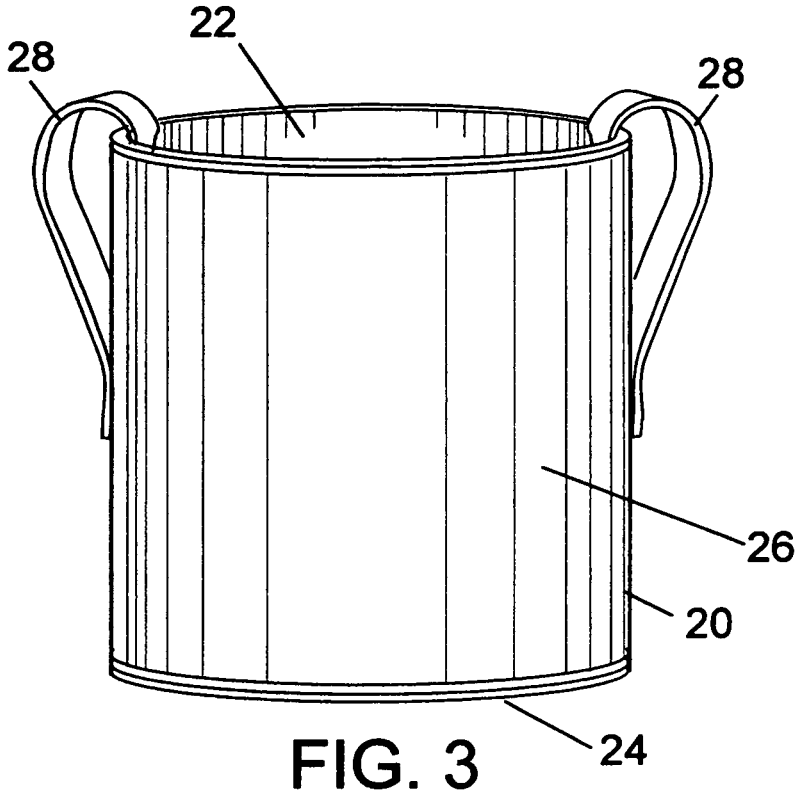
FIG. 3 illustrates a perspective open end view of a tubular screening container according to an embodiment of the invention.
Figure 2:
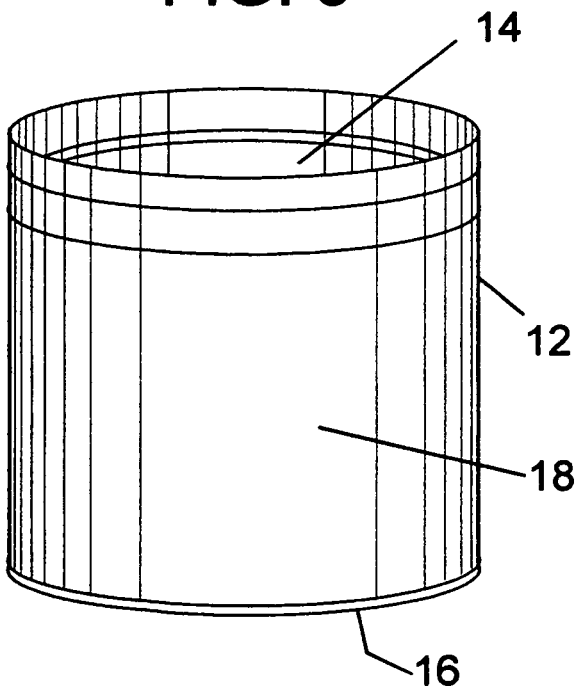
FIG. 2 illustrates a perspective open end view of a tubular container according to an embodiment of the invention.
Figure 4:
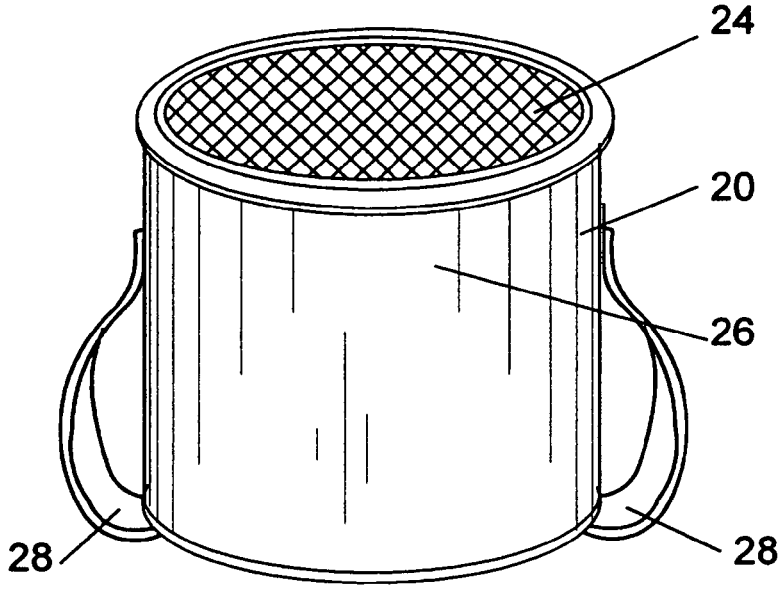
FIG. 4 illustrates a perspective screen end view of a tubular screening container according to an embodiment of the invention.
Figure 5:
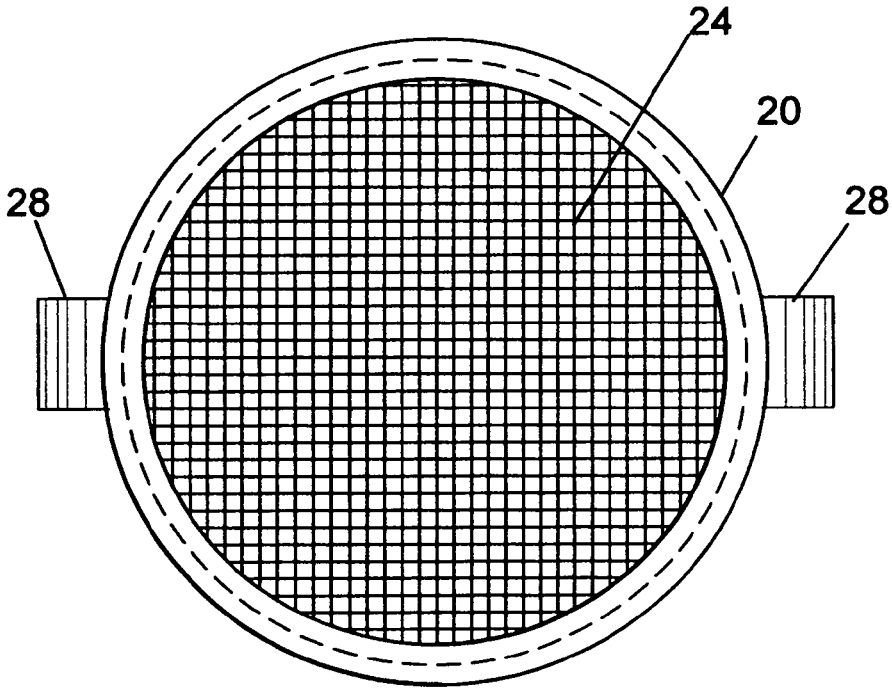
FIG. 5 illustrates a plan screen end view of a tubular screening container according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 5, a separation apparatus 10 for processing of plant extract material may have a first container 12 that may be a tubular structure with a first end as an open end 14 and a second end as a closed end 16. The tubular container 12 may be cylindrical or other suitable form such as rectangular, multi-faced side wall 18, or other cross-sectional side wall 18 shape. The tubular container 12 may be constructed of metal, plastic, composite or other suitable rigid material to maintain the tubular form when used to process material for obtaining extract.

A second container 20 may be a tubular structure sized to snugly or closely fit against the side wall 18 of the tubular container 12 when the tubular container 12 is inserted into the second container 20. The second container is a tubular screening container 20 with a first end as an open end 22 and a second end as a screened end 24. The screened end 24 may have a mesh material with a screen mesh sized to filter the plant material larger structural portion from the intended extract smaller size material. For plant material such as *stevia* plants a suitable screen mesh size of approximately 120 microns to 220 microns has been found to produce good results, and for *stevia* a screen mesh size of 185 microns has produced superior results.

The tubular screening container 20 may be constructed of a generally pliable or flexible material that is also a heat insulating material, such as, neoprene or other like flexible, insulating material. The tubular screening container 20 may be structured as a bag or pouch with a side wall 26 and a screened end 24 of mesh material sewn to the edges of the side wall 26 second end. There may also be one or more handles 28 attached at the open end 22 of tubular screening container 20 for use in placing the tubular screening container 20 over the tubular container 12.

The tubular container 12 and tubular screening container 20 may be sized for processing a particular plant material such as *stevia* in an amount desired by a user of the separation apparatus 10. Smaller sizes such as approximately 4 inches in length and 2 inches in diameter for a cylindrical structure may produce enough extract for a user application in one process operation. This size may be easily held in the hand and manipulated to produce plant extract material. Larger sizes, for example, common waste can size approximately 18 inches long and 12 inches in diameter, may also be structured and used with the handles 28 being used to aid in holding the separation apparatus while agitating or shaking it to process the plant material to obtain the desired extract material.

Figure 6:
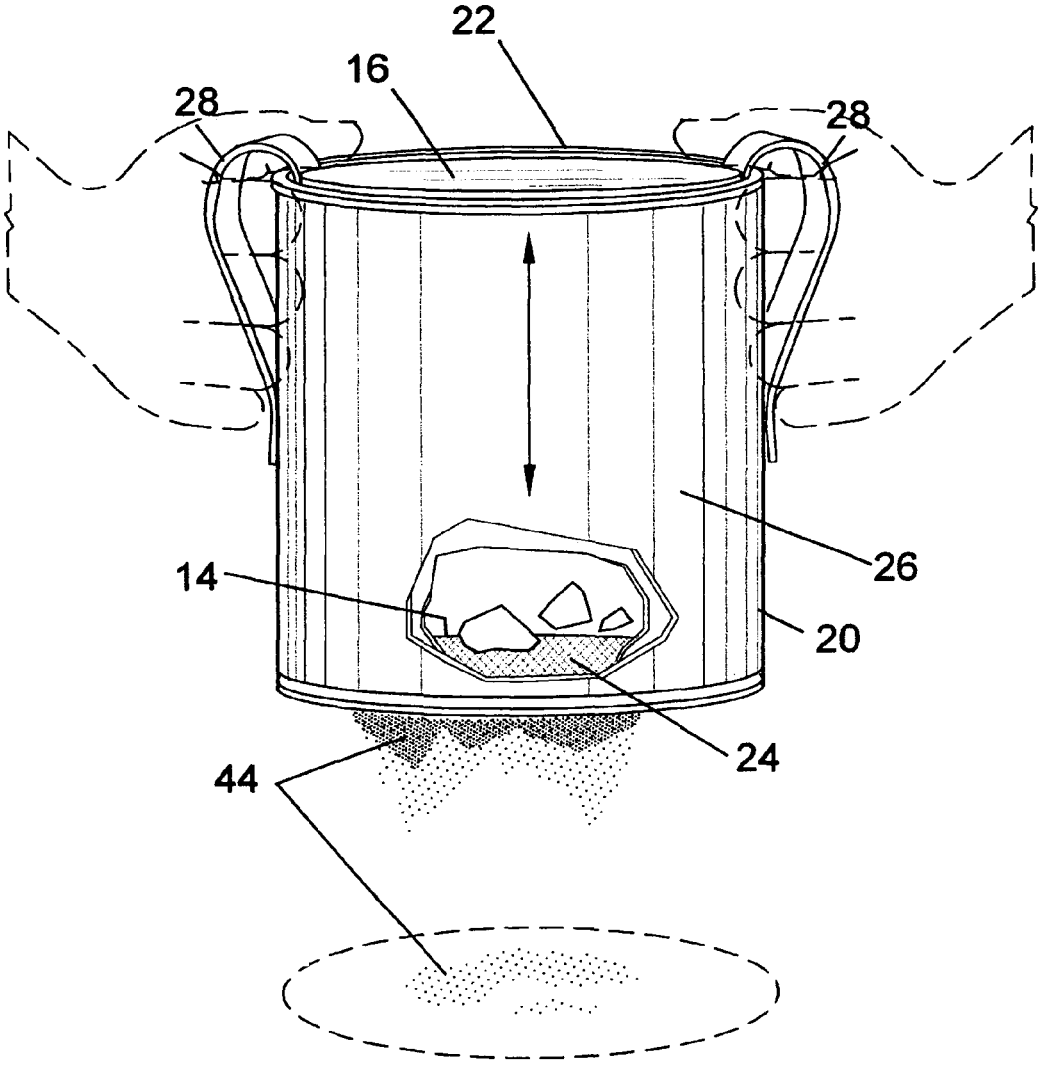
FIG. 6 illustrates a perspective view of a use of a separation apparatus according to an embodiment of the invention.

Referring to FIGS. 1 and 6, in use the separation apparatus 10 may: first have the plant material 40 placed into the bottom of the tubular container 12 with a freezing material such as dry ice 42; the tubular screening container 20 may then be placed over the tubular container 12 with the screened end 24 positioned to cover the open end 14 of the tubular container 12; and then the separation apparatus 10 may be shaken to move it in a generally up and down direction with the screened end 24 over a suitable surface to receive the screened extract material 44 from the processing. It has been found by experiment that for a plant material 40 such as *stevia* the processing time is approximately 10 minutes. It may also be possible to shake plant material 40 such as *stevia* in the separation apparatus 10 without the mixing with dry ice 42 to obtain some extract material although this may be a less efficient, slower process.

While the invention has been particularly shown and described with respect to the illustrated embodiments thereof, it will be understood by those skilled in the art that the foregoing and other changes in form and details may be made therein without departing from the spirit and scope of the invention.

We claim:

1. An apparatus for separation of plant extract material comprising:

a tubular container with an open first end and a closed second end constructed of a rigid material;

a tubular screening container with an open first end and a screen covered second end wherein said tubular screening container is sized to receive said tubular container for a close fit between a side wall of said tubular container and a side wall constructed of a heat insulating, flexible material of said tubular screening container to position said screen covered second end over said open first end of said tubular container; and wherein said screen covered second end has a screen mesh size of approximately 120 microns to 220 microns.

2. The apparatus as in claim 1 wherein a handle is attached on said side wall of said tubular screening container at said open end of said tubular screening container.

3. The apparatus as in claim 1 wherein said tubular container and said tubular screening container are between approximately 4 inches long and 2 inches in diameter to 18 inches long and 12 inches in diameter.

4. The apparatus as in claim 1 wherein said heat insulating, flexible material is neoprene.

5. A method for processing plant material to obtain plant extract material comprising:

placing a plant material into a bottom of a tubular container that has an open end and a closed end and that is constructed of a rigid material;

placing a frozen material into said bottom of said tubular container with said plant material;

positioning a tubular screening container over said tubular container to position a screened end over said open end of said tubular container and to position a first side wall of said tubular container against a second side wall of said tubular screening container; and gripping said tubular screening container to shake said tubular screening container and said tubular container for movement in a generally up and down direction with said screened end positioned over a surface to receive screened extract material.

6. The method as in claim 5 wherein said frozen material is dry ice.

7. A method for processing plant material to obtain plant extract material comprising:

placing a plant material into a bottom of a tubular container that has an open end and a closed end and that is constructed of a rigid material;

positioning a tubular screening container over said tubular container to position a screened end that has a screen mesh size of approximately 185 microns over said open end of said tubular container and to position a first side wall of said tubular container against a second side wall of said tubular screening container; and gripping said tubular screening container to shake said tubular screening container and said tubular container for movement in a generally up and down direction with said screened end positioned over a surface to receive screened extract material.

8. The method as in claim 7 wherein said plant material is one of the *stevia* genus of herbs and shrubs.

* * * * *